US007957501B2

(12) United States Patent
Williamson

(10) Patent No.: US 7,957,501 B2
(45) Date of Patent: Jun. 7, 2011

(54) SOLID TARGET SYSTEM AND METHOD FOR THE HANDLING OF A CU-64 TARGET

(75) Inventor: Andrew C. Williamson, Knoxville, TN (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 12/898,120

(22) Filed: Oct. 5, 2010

(65) Prior Publication Data

US 2011/0044788 A1 Feb. 24, 2011

Related U.S. Application Data

(62) Division of application No. 11/342,501, filed on Jan. 30, 2006, now Pat. No. 7,835,480.

(60) Provisional application No. 60/648,147, filed on Jan. 28, 2005.

(51) Int. Cl.
*G21G 1/00* (2006.01)

(52) U.S. Cl. ..... 376/202; 376/156; 376/194; 250/491.1; 250/442.11

(58) Field of Classification Search ..... 376/202, 376/156, 195; 250/419, 442.11, 429.3, 491
See application file for complete search history.

(56) References Cited

U.S. PATENT DOCUMENTS 5,608,224 A 3/1997 Alvord
6,011,825 A 1/2000 Welch et al.

OTHER PUBLICATIONS

Alton, et al., "A Multi-Sample Cs-Sputter Negative-Ion Source", ORNL/CP-101372, 1996.
Alton, et al., "A High-Intensity, RF Plasma-Sputter Negative Ion Source", ORNL Physics Division, 1987.

*Primary Examiner* — Rick Palabrica
(74) *Attorney, Agent, or Firm* — Peter L. Kendall

(57) ABSTRACT

The present invention provides a system and method for a system for accommodating a solid target in an accelerator. The system and method includes a target changer having at least one port for accommodating the solid target, an insert for receiving the solid target in the target changer, a piston for providing a vacuum and a cooling system for the solid target, a cylinder for displacing the piston in one of three positions; and a bracket for securing the insert, piston and cylinder to the target changer.

9 Claims, 4 Drawing Sheets

SOLID TARGET SYSTEM AND METHOD FOR THE HANDLING OF A CU-64 TARGET

PRIORITY CLAIM TO RELATED APPLICATION

This application claims the benefit of co-pending United States patent application entitled "TARGET SYSTEM FOR THE HANDLING OF A Cu-64 SOLID, LIQUID OR GASEOUS TARGET" filed Oct. 5, 2010 and assigned Ser. No. 12/898,087; co-pending United states patent application entitled "SOLID TARGET SYSTEM FOR THE HANDLING OF A Cu-64 TARGET" filed Jan. 30, 2006 and assigned Ser. No. 11/342,501; and United States provisional patent application filed Jan. 28, 2005 and assigned Ser. No. 60/648,147, which are incorporated by reference herein.

BACKGROUND

1. Field of the Invention

The present invention relates to the field of positron emission tomography (PET). More particularly, this invention relates to a system and method for manually loading and remotely unloading a target disk into a proton beam.

2. Description of the Related Art

Accelerators are commonly used to produce radionuclides for a variety of uses including Positron Emission Tomography (PET). PET is a noninvasive diagnostic imaging procedure that assesses the level of metabolic, biochemical, and functional activity and perfusion in various organ systems of the human body. PET provides information not available from traditional imaging technologies, such as Magnetic Resonance Imaging (MRI) and Computed Tomography (CT) which depict changes in anatomy rather than changes in physiology. Physiological activity provides a much earlier detection measure for certain forms of disease, cancer in particular, than do anatomical changes over time.

Typically, an accelerator produces radionuclides by accelerating a particle beam and bombarding a target material with the accelerated beam thereby producing radionuclides. The type of radionuclides produced are determined by the target material and particle beam used.

Low or medium energy charged-particle accelerators typically produce radionuclides having a short half life. Radionuclides such as copper-64 or $^{64}$Cu have a longer half life than the conventional radionuclides typically used. Specifically, copper-64 is the cyclotron-produced PET isotope of copper. This isotope undergoes a special type of radioactive decay, whereby its nuclei emit positrons that travel only a few millimeters in tissue before colliding with electrons, converting their total mass into two photons of energy. The photons are displaced at 180 degrees from each other and can be detected simultaneously as "coincident" photons on opposite sides of the body.

However, copper-64 is not easily producible as is shown in U.S. Pat. No. 6,011,825 which is incorporated herein in its entirety by reference. The production of copper-64 requires the irradiation of a solid target rather than a liquid or gaseous target that conventional accelerators are capable of handling.

The combination of gold with plated enriched nickel can be used to produce copper-64. Other combinations of metals can also be used to provide copper-64. In addition, the combination of metals can take the form of pellets, foil or coin.

There is a need for a target holder for loading and unloading a solid target to produce a radionuclide.

There is also a need for a target holder that can accommodate a solid as well as a liquid and gas target cost effectively.

There is a further need for a target holder that has a service position and an irradiation position

SUMMARY

An object of the present invention is to provide a solid target handling system for manually loading and remotely unloading a target disk into a proton beam.

Another object of the present invention is to provide a target handling system that can efficiently and cost effectively accommodate a solid target, a liquid target and a gas target.

An aspect of the present invention provides a system and method for a system for accommodating a solid target in an accelerator. The system and method includes a target changer having at least one port for accommodating the solid target, an insert for receiving the solid target in the target changer, a piston for providing a vacuum and a cooling system for the solid target, a cylinder for displacing the piston in one of three positions; and a bracket for securing the insert, piston and cylinder to the target changer.

Another aspect of the present invention also provides a system and method for accommodating a solid target, a liquid target and a gaseous target mounted on an accelerator. The system and method provide a target changer having four ports, two of which are service positions, an insert for receiving the solid target in the target changer, a piston for providing a vacuum and a cooling system for the solid target, a cylinder for displacing the piston in one of three positions; and a bracket for securing the insert, piston and cylinder to the target changer in one of the ports.

A further aspect of the present invention provides for the target changer being rotated from a first position to a second position, wherein the first position comprises a service/removal position and the second position comprises a beam position for irraditiating the solid target.

BRIEF DESCRIPTION OF THE DRAWINGS

The present invention will become more fully understood from the detailed description given herein and the accompanying drawings which are given by way of illustration only, and are not limitative of the present invention, and wherein.

Throughout the figures, like symbols and numbers are used throughout.

DETAILED DESCRIPTION OF EXEMPLARY EMBODIMENTS

The solid target handling system 10 is configured with several criteria. First, the system 10 is received and operates in a conventional shield envelope (not shown). The system 10 is mounted to a conventional exiting target changer hub 24 as shown and described in U.S. Pat. No. 5,608,224 which is incorporated herein by reference in its entirety, and interfaces to an existing cooling arrangement. The hub 24 also mounts to an adjustable back plate for alignment to a beam. The beam has a range of about 5 MeV to about 25 MeV. Preferably, the beam has energies at about 11 MeV.

Figure 1:
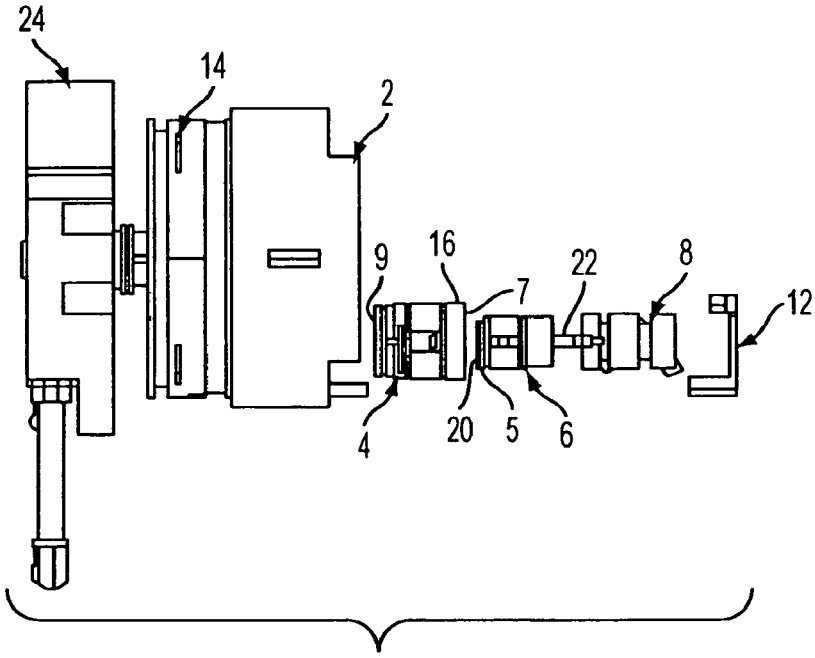
FIG. 1 is an exploded elevation view of the assembly of the target system in accordance with an embodiment of the present invention.
Figure 2:
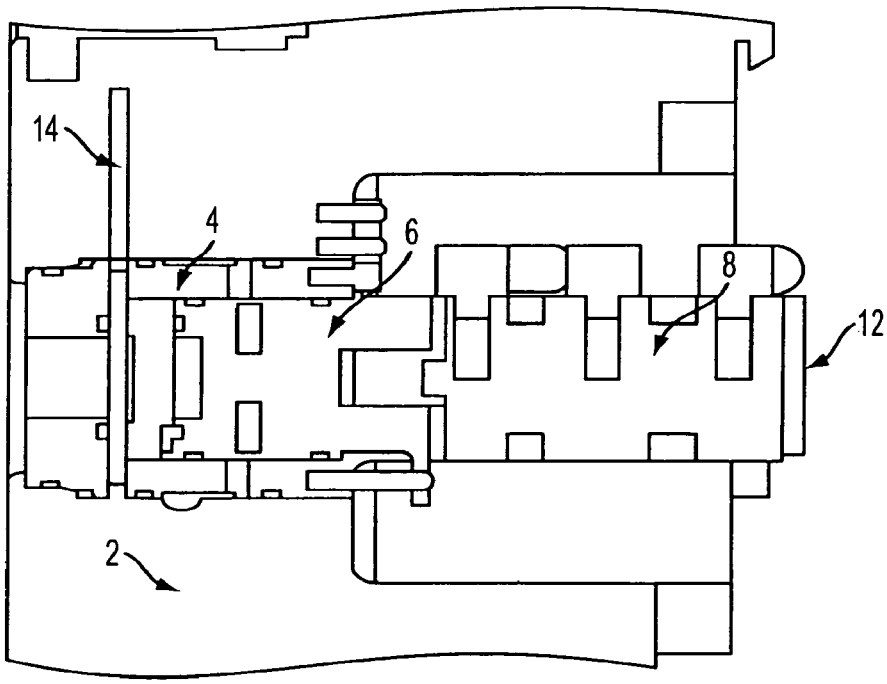
FIG. 2 illustrates an elevation view, in section, of the target assembly in accordance with an embodiment of the present invention.
Figure 3:
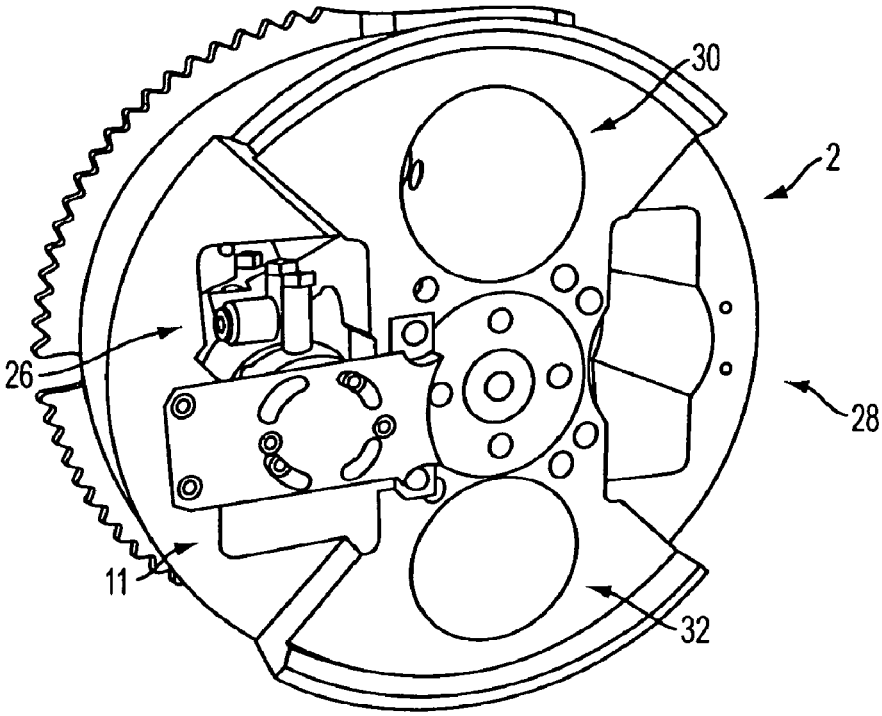
FIG. 3 is a perspective view of the target changer barrel incorporated in accordance with an embodiment of the present invention.
Figure 4:
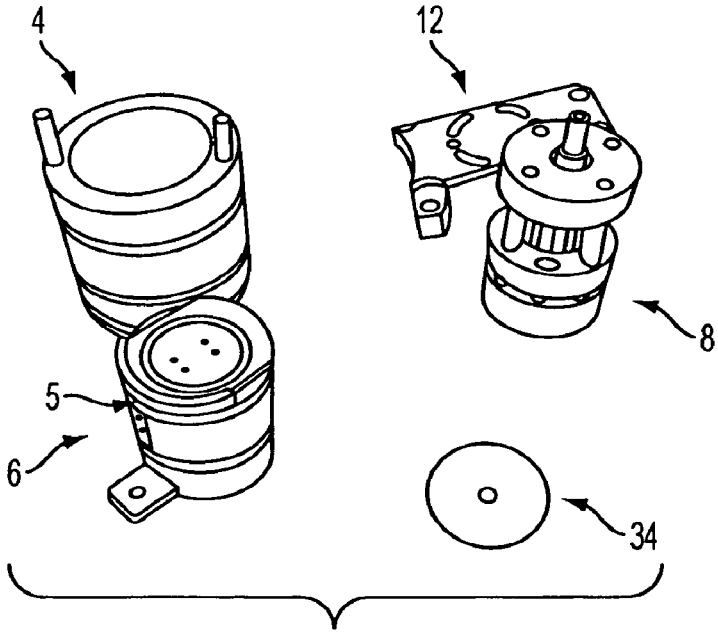
FIG. 4 illustrates various components of the target system in accordance with an embodiment of the present invention.

FIGS. 1-4 show the above described components and assembly. More specifically, FIG. 1 illustrates a target changing system in accordance with an embodiment of the present invention. FIG. 2 illustrates an elevation view, in section, of the target assembly in accordance with an embodiment of the present invention. FIG. 3 illustrates the target changer 2 having four ports in accordance with an embodiment of the present invention. FIG. 4 illustrates various components of the target system in accordance with an embodiment of the present invention.

The basic operation of the target changer interfaces with a conventional accelerator control system (not shown). The unloading of the system 10 is controlled by a remote controller not shown), positioned outside the shield, with operational logic. The system 10 accommodates all conventional eclipse style targets in two ports, and accommodates a solid target in another two ports.

The system 10 comprises a target changer 2, an insert 4, a piston 6, a shaft 22, a cylinder 8, a bracket 12 and a feed slot 14 as shown in FIG. 1. The insert 4 has an o-ring 16, a first opening 7, a second opening 9 and a cavity (not shown) providing a pass through between the first opening 7 and the second opening 9. The first and second openings of the insert 4 can be the same size; the first opening can be larger than the second opening or vice versa.

The insert 4 also includes a slot 3. The slot 3 is positioned and arranged to allow a target to fall through from the feed slot 14. The piston 6 has a tab 5 and an o-ring 20. The feed slot 14 is located within the target changer 2.

FIGS. 1, 2 and 3 together further show target changer 2 having a first port 26 for accommodating the insert 4, the piston 6, the shaft 22, the cylinder 8, and the bracket 12 all of which comprise subsystem 11. Target changer 2 also includes a third port 28 disposed about 180 degrees from the first port 26. It should be appreciated by those skilled in the art that the positions of the first port 26 and third position port 28 can vary from 180 degrees without departing from the scope of the present invention. For example, the first port 26 and the third port 28 can be 90 degrees apart without varying from the scope of the present invention.

As shown in the combination of FIGS. 1-5, first port 26 is in the service/removal position. Third port 28 is in the beam position. The target changer 2 is rotated so that the first port 26 is displaced from a service position to a beam position.

Second port 30 and fourth port 32 can accommodate conventional liquid and gas targets. In an embodiment of the present invention, target changer 2 comprises only first port 26 and third port 28. In another embodiment of the present invention, target changer 2 comprises a plurality of first ports 26 and a plurality of third ports 28. This will enable a plurality of solid targets to be accommodated and produce substantial amounts of radionuclides in a short amount of time.

In operation, the solid target is manually loaded in the first port 26 or the service position of the target changer 2. The target extraction mechanism is then attached to the target via computer control. The target is then rotated into the beam position and bombarded for the desired time and current. The target is then rotated back to the service port and unloaded.

The unloading process includes the following steps. First, the solid target is rotated to the service/removal position. The first port 26 vacuum line 40 is then vented. The cooling water valve 36 is closed, and then opened to drain. An air flush valve 42 is opened to remove all trapped water from the cooling lines. The target removal mechanism is initialized and the target is extracted from the insert 4. The target falls out of the device and to the floor of the accelerator pit aided by gravity. The fall is within a track (not shown) to control speed and location. The target changer 2 is then available to manually load another solid target.

FIG. 4 illustrates an exemplary target 34. Target 34 is a solid target and preferably comprises a combination of enriched nickel and gold sufficient to provide copper-64.

Figure 6:
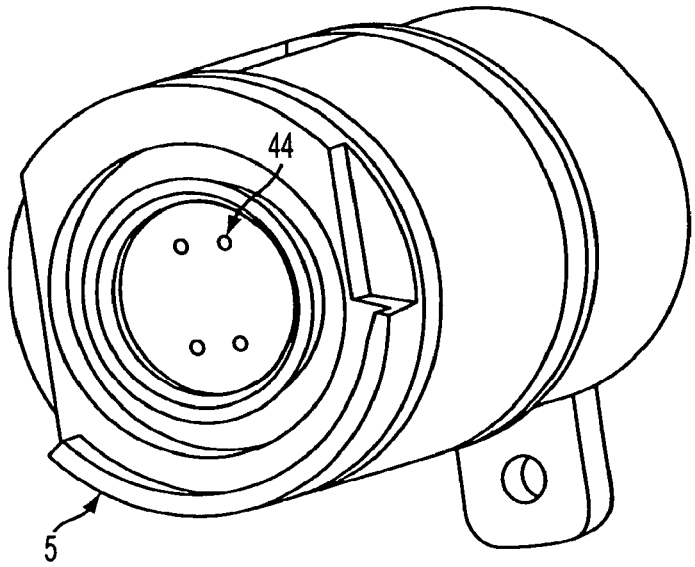
FIG. 6 illustrates the routing of water through the piston to the target disk in accordance with an embodiment of the present invention.
Figure 7:
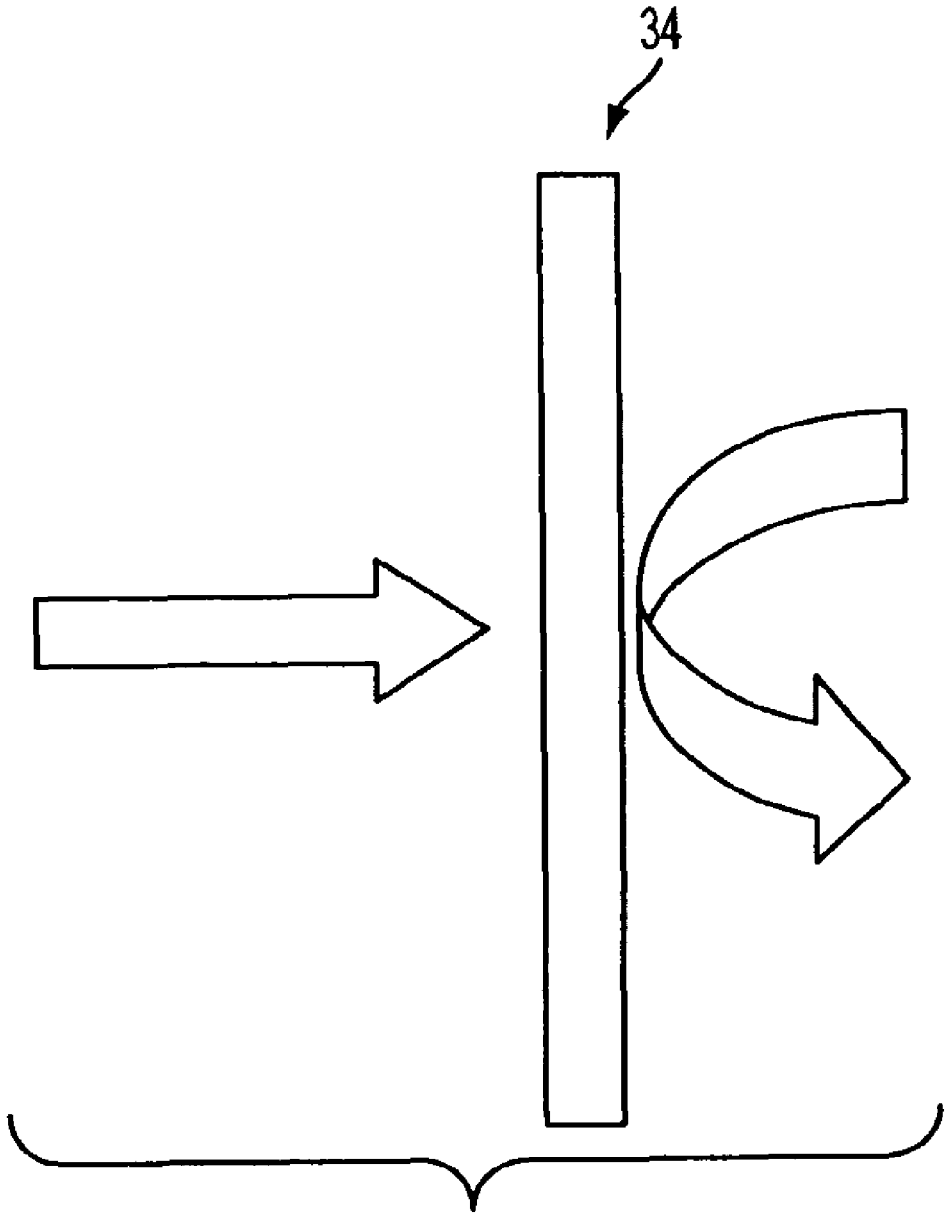
FIG. 7 illustrates the results of target cooling calculations.

The piston 6 fits within the insert 4 and channels cooling water to the solid target via perforations 44 (See FIGS. 1, 4 and 6). The insert serves as the vacuum seal between the target and the accelerator. The piston has three positions within the insert. A load, extended and extraction position. The load position is such that the tab 5 on the piston extends into the slot 3 of the insert 4 preventing the target from continuing to fall out of the feed slot 14 where it exits the target changer. Specifically, the tab 5 (see mark up to FIG. 4) stops the target disk as it falls into the target changer 2 and positions the target in the center of the beam.

In the extraction position the piston 6 is extracted in the insert 4. It should be appreciated by those skilled in the art that the extraction position can comprise a location where the piston 6 is still in the insert 4 but the tab 5 is not blocking feed slot 14.

The three positions of the piston are controlled by a pneumatic cylinder 8 manufactured by Bimba. The cylinder is held in position by the bracket 12, which is connected to first port 26 via screws and precisely positions the cylinder 8 so that the stroke lengths are as needed. The displacement of shaft 22 which is connected to cylinder 8 at one end and piston 6 at a distant end causes piston 6 to move in a lateral direction.

In an embodiment of the present invention, the system 10 is configured to accommodate a solid target having a range between 0.5 mm to 5 mm thickness and 10 mm to 35 mm in diameter. Preferably the target disk has 2 mm thickness and 25 mm diameter. The solid target preferably has a thermal conductivity greater than 2200 BTU-in/hr-$Ft^2$-° F.

In accordance with an embodiment of the present invention, system 10 operates in the following manner. When first port 26 is in the service position, the target 34 is dropped either manually or remotely into the feed slot 14 of the target changer 2. The feed slot 14 was formed via a rectangular slot that was burned into the target changer 2 via EDM. The feed slot 14 allows the target disk to fall by gravity into the insert 4. The target enters the insert 4 via the insert slot 3 and is prevented from passing through the insert 4 by the piston tab 5 because the piston 6 is in the load position.

Air is removed via air inlet 40 compressing the target against the o-ring 16 of insert 4. The piston is placed in an extended position compressing the target against O-ring 20 of the piston 6.

The port 26 is rotated by the hub 24 from a service position to a beam position where the target is irradiated for a predetermined period by a beam having a predetermined energy. An exemplary predetermined time period can be 2 hours of 40 uA operation for the accelerator.

In an embodiment of the present invention, the rotation can be clockwise. In another embodiment of the present invention, the rotation can be counter clockwise.

Water is input via inlet 36 and the perforations 44 of the piston 6 to maintain the temperature of the target below a predetermined threshold temperature so that the target does not melt. Water is removed via outlet 38.

The target changer 2 is rotated clockwise so that first port 26 is positioned to be in a removal position. In another embodiment of the present invention rather than continuing forward in a clockwise direction, the target changer 2 is rotated in a counter clockwise position.

In the removal position, air is provided to port 26 via inlet 42, the piston 6 is placed in an extracted position causing the target to fall through slot 3 of the insert 4 via gravity out of the target changer 2 where the target is automatically unloaded and interfaces with a customer supplied transport system.

The insert is designed to fit within the target changer. It functions to position the 25 mm diameter solid target in the larger target slot. It provides cooling water and vacuum seals. It also has integral tabs to strip the target disk from the piston during extraction.

The beam position compresses the target disk between two face seal O-rings for vacuum seal. The extract position pulls the piston back within the insert and allows the target disk to fall into the exit feed slot.

Figure 5:
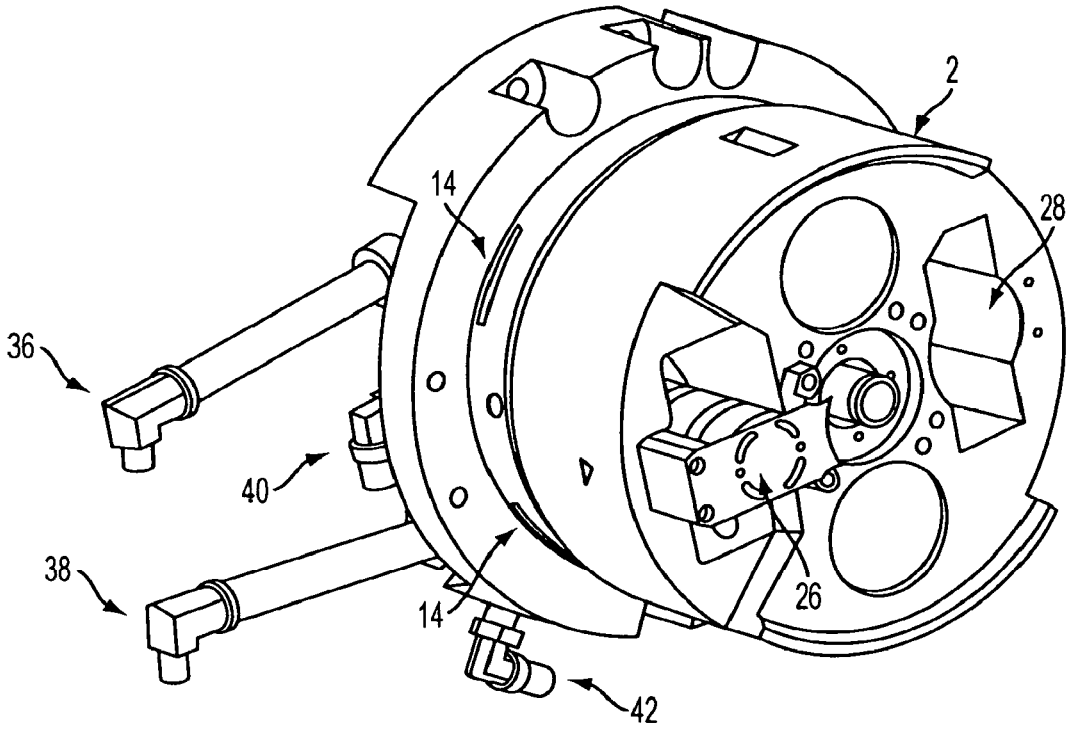
FIG. 5 illustrates the operation of the target assembly in accordance with an embodiment of the present invention.

The operation of the target assembly of the present invention is illustrated in FIG. 5.

Target Cooling: The target disk is cooled by water jets normal to its non-beam side surface. The water is routed through the insert as indicated in FIG. 6. The target disk is cooled by conduction through the disk and convection from the disk into the cooling water. Conduction is calculated by Fowlers Law:

$$q = KA\frac{dt}{dl}.$$

Since the heat transmission is steady and the K and L are constant, this becomes:

$$q = \frac{KA\Delta T}{L},$$

where:

q=heat input;

K thermal conductivity of material;

A=area of heat conduction;

$\Delta T=(T_2-T_1)$; and

L=thickness of target disk.

In the instant case, where:

q=10.5 MeV×60 uA=630 W=2150 btu/hr;

K=2200 btu-in/hr-ft2-° F. (for gold);

A=0.00136 ft2; and

L=2 min=0.079 in, then:

ΔT=57° F.

To estimate the value for "h", the coefficient of heat transfer used in the following equations are used:

$H=Nu(K_{water})/L$;

$Nu=0.228\ Re^{0.731}Pr^{0.33}$ $Re=VL\rho/\mu$; and $Pr=Cp\mu/K_{water}$, where:

Nμ=Nusselt number;

Re=Reynolds number;

Pr=Prandlt number;

$K_{water}$=thermal conductivity of water=0.58 W/m K;

L=length of flow=0.019 m;

P=density of water=1000 kg/m3;

M=viscosity of water=0.00114 kg/m-s;

Cp=specific heat of water=4180 KJ/kg-K; and

V=velocity of flow=4.3 m/s.

From this, the results yield:

Pr=8.2;

$Re=7.2\times10^4$;

Nu=1627; and

H=49,667 W/k=8741 btu/hr-ft2-° F.

Convection is calculated by Newton's Law of Cooling for forced convection.

$q=hA\Delta T$ where:

q=heat input;

h=coefficient of heat transfer;

A=area of heat convection; and $\Delta T=(T_{wall}-T_{water})$.

In the instant case, where:

q=10.5 MeV×60 uA=630 W=2150 btu/hr;

h=8741 btu/hr-$ft^2$-° F.; and

A=0.00136 $ft^2$, then:

ΔT=180° F.

The results show that where the temperature of the cooling water is 45° F., the temperature of the wall on the cooling water side is 225° F. and the temperature of the wall on the beam side is 282° F.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicants general inventive concept.

What is claimed is:

1. A method for accommodating a solid target in an accelerator system having:

a rotating target changer having at least one feed through slot dimensioned for passage of the solid target;

an insert having a cavity with a radial circumference, the cavity radial circumference in communication with the feed through slot and passing the solid target therethrough;

a piston having a tab, slidably received and retained within the insert cavity before the target is loaded into the insert;

a cylinder coupled to the piston, which displaces the piston in one of three positions within the cavity; and a bracket coupled to the insert, cylinder and target changer;

the method comprising:

placing the piston in the first position, which is a load position;

receiving the solid target within the insert via the feed through slot; and securing the solid target within the insert via a tab of the piston which prevents passage of the solid target out of the insert cavity.

2. The method of claim 1, further comprising:

rotating the target changer from a first position to a second position, wherein the first position is a service position and the second position is a beam position where the solid target is irradiated by a beam for a predetermined time at a predetermined current.

3. The method of claim 1, further comprising placing the piston in the second position, which is an extended position.

4. The method of claim 1, further comprising placing the piston in the third position, which comprises an extracted position.

5. The method of claim 1, wherein the system accommodates a solid target, a liquid target and a gaseous target; and the target changer has four ports and a service position.

6. A method for accommodating a solid target in an accelerator system having:

a rotating target changer having at least one feed through slot dimensioned for passage of the solid target;

an insert for passage of the solid target therethrough having:

a cavity with a radial circumference and first and second axial openings;

a piston having a tab slidably received within the first opening during target passage through the insert; and at least one insert slot defined within the cavity between the piston and second opening that is in communication with the feed through slot and receiving the solid target therein when the target changer is in a load position;

a cylinder coupled to the piston, which displaces the piston within the cavity; and a bracket coupled to the insert, cylinder and target changer;

the method comprising:

placing the piston in the first position, which is a load position;

receiving the solid target within the insert via the feed through slot; and securing the solid target within the insert via a tab of the piston which prevents passage of the solid target out of the insert cavity.

7. The method of claim 6, further comprising:

rotating the target changer from a first position to a second position, wherein the first position is a service position and the second position is a beam position where the solid target is irradiated by a beam for a predetermined time at a predetermined current.

8. The method of claim 7, further comprising placing the piston in the second position, which is an extended position.

9. The method of claim 8, further comprising placing the piston in the third position, which comprises an extracted position.

* * * * *